United States Patent [19]

Beretta

[11] Patent Number: 4,663,878

[45] Date of Patent: May 12, 1987

[54] REMOVABLE HANDLE WITH AUXILIARY SIGHTS FOR TRANSPORTING AUTOMATIC RIFLES

[75] Inventor: Pier G. Beretta, Gardone V.T., Italy

[73] Assignee: Fabbrica d'Armi P. Beretta S.p.A., Italy

[21] Appl. No.: 851,457

[22] Filed: Apr. 14, 1986

[30] Foreign Application Priority Data

May 24, 1985 [IT] Italy ..... 5173 A/85

[51] Int. Cl.[4] ..... F41G 1/08

[52] U.S. Cl. ..... 42/100

[58] Field of Search ..... 89/41.17, 1.4, 1.1; 42/100, 101, 102, 1 A, 1 S, 1 SR, 1 ST, 75 A, 75 C

[56] References Cited

U.S. PATENT DOCUMENTS 3,153,856 10/1964 Felix ..... 42/100

3,742,636 7/1973 Dealy et al. ..... 42/100

FOREIGN PATENT DOCUMENTS 0962864 4/1957 Fed. Rep. of Germany ..... 42/1 ST 0399959 4/1966 Switzerland ..... 42/1 ST

*Primary Examiner*—Stephen C. Bentley

*Assistant Examiner*—Stephen Johnson

*Attorney, Agent, or Firm*—McGlew and Tuttle

[57] ABSTRACT

A removable handle for portable, automatic weapons is disclosed, which allows the easy grasp of the weapon and its transportation, without affecting the line of sight.

The handle is provided, at one extremity, with a spring-loaded dowel for engagement in a cavity provided in the base of the rear sight and, at the opposed extremity, with a blocking bolt or pawl which dove-tails and couples with the forward attachment of the weapon. The blocking bolt or pawl prevents the accidental disengagement of the handle from the body of the weapon.

7 Claims, 5 Drawing Figures

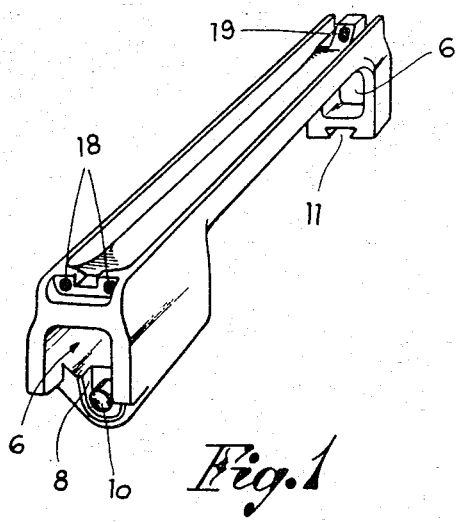
Fig. 1
Fig. 2
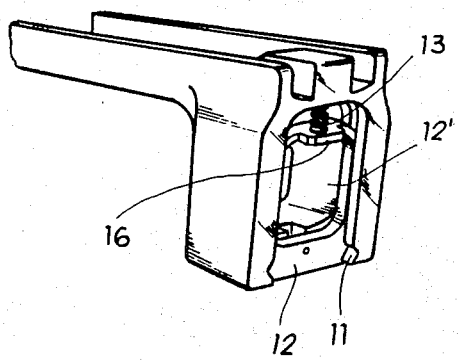
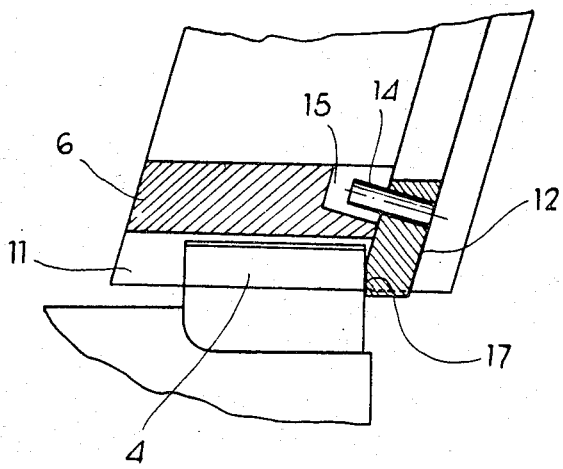
Fig. 5

REMOVABLE HANDLE WITH AUXILIARY SIGHTS FOR TRANSPORTING AUTOMATIC RIFLES

FIELD OF THE INVENTION

The present invention relates to handles for portable automatic weapons, such as portable automatic rifles, and in particular to handles which are both removable from the rifle stock and provided with auxiliary sights.

BRIEF DESCRIPTION OF THE PRIOR ART

In the field of portable automatic weapons, such as portable automatic rifles and the like, the need has been felt to provide the weapon proper with a handle, so as to facilitate the transport of the weapon, without, however, adding new elements to the body of the weapon and without affecting the line of sight.

There are already known some types of automatic rifles, which have means for attaching a telescopic sight, such means consisting of cavities or seats provided in the base of the sight and of fastening members fixed to the forward portion of the body of the rifle, that is, spaced from the base of the sight. The telescopic sight is, usually, provided with a spring-loaded dowel which engages the cavity or seat mentioned above and with a dove-tailed portion which engages the above mentioned forward portion. When the engagement is effected, the spring-loaded dowel is then axially blocked, so as to prevent the disengagement, accidental or not, of the telescopic sight.

Now, in the event that a handle device is mounted simply as a telescopic sight, and as a replacement therefor, the attachment is counter-productive, in that the line of sight and aiming is interrupted.

BRIEF DESCRIPTION OF THE INVENTION

Starting from the above premise, it is, therefore, the scope of the present invention to provide a handle which is applicable to portable automatic weapons, such as portable automatic rifles, and exploits means of support and attachment that are already existing on such rifles and which at present are used for supporting telescopic sights.

It is another object of the invention to provide a handle which is applicable to, but detachable from the rifle, without affecting the line of sight and aiming of the weapon, the handle having longitudinal apertures for ready accessibility and visibility of the means for aiming the weapon, even when the handle is attached to the automatic rifle.

It is a further object of the invention to provide a handle for portable automatic rifles which carries auxiliary sights particularly visible and, if needed, luminous, so as to allow the aiming of the weapon also under conditions of poor visibility or in critical sighting conditions.

Briefly stated, the invention is directed to a removable handle, particularly suited for portable automatic weapons that have a rear sight and a forward attachment spaced from the rear sight. The removable handle comprises a body having at least one longitudinal aperture, horizontally aligned with the rear sight, a spring-loaded dowel which engages a cavity or seat provided in the base of the rear sight of the weapon, a portion which is dove-tailed with said forward attachment fixed to the body of the weapon, and a blocking bolt or pawl which cooperates with said forward attachment in order to prevent the longitudinal displacements, as well as the accidental disengagement, of the handle.

THE DRAWINGS

An example of practical realization of the invention will be described in greater detail in the following pages, with reference to the accompanying drawings, which are merely illustrative of the invention, and in which:

FIG. 1 is a perspective view of the handle of the invention, seen from a rear position;

FIG. 2 is a perspective view of the forward portion of the handle;

FIG. 5 is an enlarged, detailed view of the blocking bolt or pawl of the handle.

DETAILED DESCRIPTION OF THE INVENTION

Figure 4:
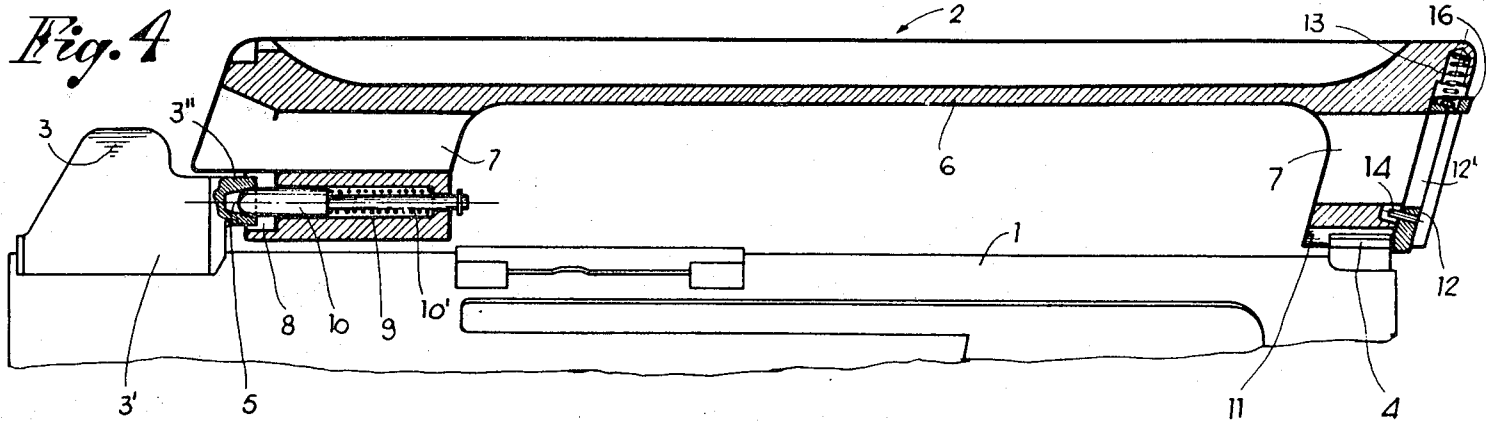
FIG. 4 is a longitudinal, sectional view of the handle as it is fixed to the weapon.
Figure 3:
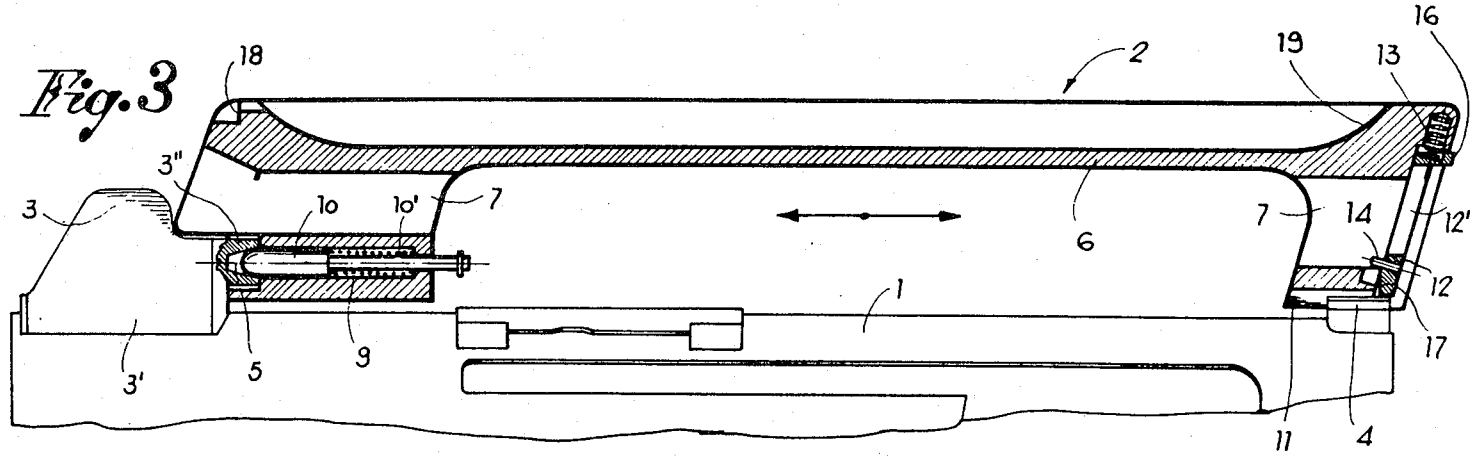
FIG. 3 is a longitudinal sectional view of the handle, in phase of being mounted or removed from the weapon.

With reference to the accompanying drawings, to the body 1 of the automatic rifle is applied a handle 2, in order to facilitate the grasping and the transporting thereof. On the body 1 of the weapon are fixed a rear sight 3 and a forward attachment 4, spaced from the rear sight and suitably shaped, for instance dove-tailed. The rear sight 3 has a base 3' which is provided in its forward portion with a protrusion 3'' in which a cavity or seat is present 5. Cavity or seat 5 has its mouth open toward the forward attachment 4, this latter being in turn longitudinally oriented on and with respect to the weapon's body itself.

The handle 2 consists of a body 6 in which are longitudinal carved one or more apertures 7 which are horizontally aligned with the rear sight 3, so as to permit a proper, correct and complete visibility of the line of aiming of the weapon.

At the rear extremity of the body of the handle, below the plane of the openings or apertures 7, there is an insert 8 which has the function of axially coupling with the forward protrusion 3'' of the base 3' of the rear sight 3. In correspondence with the insert 8 there is an opening 9 within which is seating and sliding the dowel 10. Dowel 10 is spring-loaded by the spring 10' and extends within the protrusion 3'' of the base 3'. At the base of its forward section, the body 6 of the handle 2 has a dove-tailed seat 11, although the shape or profile thereof may be different, which seat 11 has the function of coupling in the longitudinal direction with the forward attachment 4 fixed to the body of the weapon. On the forward head of the body of the handle, there is mounted and guided with a pre-established angle of incidence upon the attachment 4 a blocking bolt or pawl 12.

As clearly seen in the accompanying figures, the blocking bolt 12 has a window 12' which is coincident with the longitudinal apertures 7 of the handle. The blocking bolt or pawl 12 is urged by a spring 13, which, normally, keeps it spaced in a downward direction toward the forward attachment 4. The maximum downward displacment of the blocking bolt or pawl 12 is limited by an arresting pm or dowel 14 which is arranged in a recess or cavity 15 provided in the body of the handle (see FIG. 5).

The blocking bolt or pawl 12 is further provided, in its own intermediate portion with a grasping wing or tab 16 for the manual operation of the bolt or pawl 12. Element 17, in the lower part of the blocking bolt or pawl 12 interacts with the head of the forward attachment 4, so as to block the handle when properly applied to the weapon and to prevent any axial movement or axial play.

Handle 2 is applied to the firearm by resting or seating the dowel 10 within the cavity 5, moving then rearwardly the handle against the action of its own spring 10', so as to prepare the seat 11 for the dove-tailed coupling, in the axial direction, of the forward portion of the handle with the forward attachment 4 of the firearm. Finally, by moving forwardly the handle, with the help of the spring 10', the blocking bolt or pawl 12 is urged by its own spring 13 to engage element 17 at the head of the forward attachment 4 of the weapon. The condition of attachment of the handle 2 is represented by FIGS. 4 and 5 of the accompanying drawings, from which it can be appreciated how the contrasting actions of the spring-loaded dowel 10, on one hand, and of the blocking bolt or pawl 12, on the other hand, permit the axial blockage of the handle, preventing all movements, as well as any accidental disengagement or uncontrolled separation from the weapon body. Once mounted, the handle facilitates considerably the grasping and the transport of the firearm, without impeding, thanks to the longitudinal apertures 7, the correct employment and utilization of the firing sight.

In the upper part of the handle 2 there can be, if desired, and advantageously provided, an auxiliary sight consisting, for example, of two framing points 18 positioned at the rear extremity of the handle and of a counter-point 19 provided at the opposite, foward extremity, as shown clearly in FIG. 1 of the drawings.

These sight points 18–19 are especially evident, and if desired purposely luminescent, so as to permit the utilization of the weapon also under conditions of poor visiblity and when it is not possible to use the traditional line of sight.

In order to detach the handle, it is sufficient to act on the wing or tab 16 of the blocking bolt or pawl 12. The bolt or pawl is then displaced upwardly and detached from its position with element 17. Then, employing a succession of steps inversely to the mounting operation, the handle is displaced toward the rear to disengage it from the forward attachment 4, and then upwardly to disengage it also from the base of the rear sight 3.

What is claimed is:

1. A removable handle construction for a portable automatic weapon having a weapon body, comprising:

a rear sight (3) fixed to the weapon body (1) and having a forwardly extending protrusion (3'') with a forwardly facing cavity (5) therein;

a forward attachment (4) fixed to the weapon body (1) and spaced forwardly of said rear sight (3);

a handle body (2) having at least one longitudinally extending aperture (7) which is horizontally aligned with said rear sight (3), said handle body having a longitudinally extending opening (9) therein below said at least one longitudinally extending aperture (7);

a dowel (10) movably mounted in said longitudinally extending opening (9);

a first spring (10') engaged between said dowel and said handle body for biasing said dowel rearwardly into engagement with said forwardly facing cavity (5);

said handle body having a dove-tailed seat (11) for engagement with said forward attachment (4) to preclude upward and downward movement between said dove-tailed seat and said forward attachment, said dove-tailed seat being shaped to permit forward and rearward movement between said seat and said forward attachment;

a blocking unit (12) mounted for movement to said handle body adjacent said seat (11) for movement toward and away said from said forward attachment (4) and having and end for engagement against a surface of said forward attachment for precluding relative axial movement between said handle body and said forward attachment and;

a second spring (13) engaged between said blocking bolt (12) and said handle body for biasing said blocking blot into engagement with said surface of said forward attachment.

2. A construction according to claim 1 wherein said blocking bolt includes a forwardly extending tab which is manually engageable for moving said blocking bolt against the biasing of said second spring to disengage said blocking bolt from said forward attachment to permit relative forward and rearward movement between said handle body and said forward attachment.

3. A construction according to claim 2 wherein said at least one longitudinal aperture includes an aperture through a rear portion of said body handle above said dowel and an aperture through a forward portion of said handle body above said dove-tailed seat.

4. A construction according to claim 3 wherein said bolt includes a window there through aligned with said at least one longitudinal aperture through said forward portion of said handle body.

5. A construction according to claim 4 wherein said forward portion of said handle body includes a recess (15), and an arresting pin connected to said blocking bolt and extending into said recess for limiting an downward relative movement between said blocking bolt and said handle body.

6. A construction according to claim 5 wherein said handle body includes an upper longitudinal portion betwee said rear and forward portions, a pair of spaced apart framing points at a rear area of said upper longitudinal portion and a central framing point at an area of said upper longitudinal portion which is alignable between said pair of spaced apart framing points for sighting the automatic weapon.

7. A construction according to claim 4 wherein said blocking bolt is mounted for movement at an angle to the upward and downward direction, said angle being inclined from and upper part of said handle body downwardly and rearwardly toward said forward attachment.

* * * * *